US006533324B2

(12) United States Patent
Zorn

(10) Patent No.: US 6,533,324 B2
(45) Date of Patent: Mar. 18, 2003

(54) ADVERTISING BROCHURE AND METHOD FOR ITS USE

(75) Inventor: Richard Zorn, Rivervale, NJ (US)

(73) Assignee: Moore U.S.A., Inc., Grand Island, NY (US)

( * ) Notice: Subject to any disclaimer, the term of this patent is extended or adjusted under 35 U.S.C. 154(b) by 46 days.

(21) Appl. No.: 09/799,125

(22) Filed: Mar. 6, 2001

(65) Prior Publication Data

US 2001/0009331 A1 Jul. 26, 2001

Related U.S. Application Data

(62) Division of application No. 09/497,180, filed on Feb. 3, 2000, now Pat. No. 6,276,724, which is a division of application No. 09/074,461, filed on May 8, 1998, now Pat. No. 6,129,346.

(51) Int. Cl.[7] ..... B42D 15/00

(52) U.S. Cl. ..... 283/56; 283/61; 40/124.06

(58) Field of Search ..... 283/56, 63.1, 61, 283/62, 117; 281/2, 5, 38; 402/79; 383/127; 229/87.06, 92; 40/124.06

(56) References Cited

U.S. PATENT DOCUMENTS

| | | | | |
|---|---|---|---|---|
| RE31,710 E | | 10/1984 | Jackson | |
| 4,559,727 A | | 12/1985 | Lewyt | |
| 4,576,370 A | | 3/1986 | Jackson | |
| 4,722,554 A | | 2/1988 | Pettit | |
| 5,114,128 A | | 5/1992 | Harris, Jr. et al. | |
| 5,186,443 A | | 2/1993 | Manley et al. | |
| 5,230,501 A | | 7/1993 | Melton | |
| 5,269,563 A | | 12/1993 | Michlin | |
| 5,308,119 A | | 5/1994 | Roshkoff | |
| 5,314,176 A | | 5/1994 | Schmitt | |
| 5,489,123 A | | 2/1996 | Roshkoff | |
| 5,513,914 A | * | 5/1996 | Faber | 283/56 |
| 5,547,175 A | | 8/1996 | Graushar et al. | |
| 5,590,912 A | | 1/1997 | Stevens | |
| 5,636,346 A | | 6/1997 | Saxe | |
| 5,687,322 A | | 11/1997 | Deaton et al. | |
| 5,803,499 A | * | 9/1998 | Tung et al. | 283/56 |
| 5,845,942 A | | 12/1998 | Hansen et al. | |
| 5,967,557 A | * | 10/1999 | Dahlquist | 283/56 |
| 5,970,480 A | | 10/1999 | Kalina | |
| 5,992,889 A | * | 11/1999 | Barnett et al. | 283/56 |
| 6,028,902 A | | 2/2000 | Carson | |
| 6,070,147 A | | 5/2000 | Harms et al. | |

FOREIGN PATENT DOCUMENTS

| | | |
|---|---|---|
| DE | 28 34 675 | 2/1980 |

* cited by examiner

*Primary Examiner*—Willmon Fridie, Jr.
(74) *Attorney, Agent, or Firm*—Nixon & Vanderhye P.C.

(57) ABSTRACT

An advertising or promotional brochure is disclosed that is to be mailed in conjunction with a magazine or periodical. The brochure may include high-quality, glossy photographs, and be personalized with text and/or images that relate specifically to the magazine subscriber. In addition, the brochure may include coupons for sales discounts, bank promotional checks, and other promotions that may be redeemed by the magazine subscriber. The brochure may be embodied as a multi-page pamphlet and may have an appearance and cover similar to the magazine to which it is attached.

11 Claims, 11 Drawing Sheets

ADVERTISING BROCHURE AND METHOD FOR ITS USE

This application is a division of Ser. No. 09/497,180, filed, Feb. 3, 2000, now U.S. Pat. No. 6,276,724, which is a division of Ser. No. 09/074,461, filed May. 8, 1998, now U.S. Pat. No. 6,129,346 issued Oct. 10, 2000.

FIELD OF THE INVENTION

The present invention relates to the field of advertising and promotional brochures, and in particular, to the design of advertising and promotional inserts to magazines.

BACKGROUND AND SUMMARY OF THE INVENTION

Advertising and promotional inserts are well known for magazines and other types of periodicals. These inserts can be as simple as a postcard insert that is placed between two pages of a magazine, and is not attached to the magazine. However, these postcard inserts routinely fall out from between the magazine pages, when the magazine is opened. Another type of insert is an attached postcard that is secured to the magazine by, for example, the center staples used to bind the pages of the magazine. A multi-ply advertising insert for a magazine where the insert forms a pocket for a return brochure is described in U.S. Pat. No. 5,269,563. A third type of promotion included with magazines are product inserts, such as sample products of toothpaste, computer software CDROMS and other small samples, that are included within the pages of the magazine or enclosed within the plastic wrapper for the magazine.

An advantage of advertising inserts in a magazine or periodical is that their is no postage cost for the insert itself. The mailing cost is only that associated with mailing the magazine. There is no additional postage cost due to the advertising insert. The cost of mailing advertising and promotional materials usually represents a substantial portion of the costs associated with those materials. Even when advertising and promotional materials are sent at bulk mail rates, the postage costs are substantial to separately mail advertisements and promotions. Inserting advertising and promotional materials in magazines is one technique used to avoid (or at least lessen) the costs of mailing advertisements and promotions.

Prior advertising and promotional inserts for magazine have not been effective as other types of brochures, and have not fully utilized the free postage advantage held by the inserts. These inserts tend to be small and provide limited information, in contrast to separately mailed, high-quality brochures and catalogs that include glossy photographs and detailed descriptions of products and services. The inserts are in stark contrast to the color photographs and extensive written text materials provided on the advertisements and articles on the pages of the magazines that include the inserts. Adverting inserts in magazines also are not personal, in that they are not addressed to the magazine subscriber, do not refer to the subscriber by name, and do not provide information tailored to the subscriber. In summary, the inserts and other promotional materials conventionally included in magazines have not been at the same high quality printing of the magazine itself. Accordingly, a long-felt need has existed for high-quality advertising inserts and attachments for magazines that are personalized, utilize promotions to entice magazine subscribers to purchase the product or use the service being advertised or effectively utilize the free postage associated with mailing the advertisement with the magazine.

The present invention is an advertising or promotional brochure, e.g., such as Moore's promotorial (sm), to be mailed in conjunction with a magazine, periodical, or other publications mailed using us. Postal service standard or periodical rates. The brochure may include high-quality, glossy photographs, and be personalized with text and/or images that relate specifically to the magazine subscriber. In addition, the brochure may include coupons, such as for product price discounts, bank checks, rebates, etc. (collectively referred to as coupons) for sales discounts and other promotions that may be redeemed by the magazine subscriber. The brochure may be embodied as a multi-page pamphlet that has an appearance and cover similar to the magazine to which it is attached. Accordingly, the present invention provides an advertising and promotional brochure that is every bit as appealing to the magazine subscriber, as is the magazine itself The brochure is intended to effectively use the free postage for riders and other inserts to magazines and periodicals. In this regard, the advertising brochure may have substantial portions, e.g., at least 25% of its page area, devoted to editorial and/or public service information to satisfy postage regulations for free postage. A magazine-type layout for the brochure is well-suited to the presentation of editorial and public service information, and thus magazine-type layouts are particularly suited for the present invention.

The present invention solves the long-felt need for a high-quality, personalized magazine insert or attachment. The same high-quality photographs, graphics and text used in a magazine may also be used to create the layout of the present inventive brochures. In addition, the present inventive brochures may include personalized information, such as the name and address of the magazine subscriber, and information related to the subscriber. It is believed that magazine subscribers are more likely to read and act on a promotional or advertising brochure made in accordance with the present invention, than on other conventional magazine inserts.

The invention also includes a new method and arrangement of form assembly apparatuses for assembling and printing an advertising or promotional brochure for mailing with a magazine or other type of periodical. For example, the advertising or promotional brochure is formed from two or three continuous webs. The front and back cover of the advertising promotion are formed from a first web, and coupons and insert pages to the brochure are formed from a second web. Printers, such as color laser printers, ink-jet prints and the like, are used to imprint photographs, graphics and text onto both webs to form the high-quality, glossy color printing used in the brochure. In addition to fixed text, photographs and graphics, the printers may imprint variable information, such as the magazine's subscribers name and address onto the web. The variable printers are controlled by computers that merge variable data with the fixed text and graphics as the printing process is ongoing.

The first web is perforated along a transverse line to define the top and bottom edges of the cover sheet to the advertising promotion. A folder can crease the web longitudinally, or in a zig-zag manner to form the cover sheet, which is then ready for assembly with the coupons (such as live checks) and inserts formed from the second web. The second web is cut into coupons, and, if desired, into small individual sheets which are inserted in the cover sheet and attached thereto to form the advertising or promotional brochure. At this point the brochure is ready for attachment to the magazine, such as by a glue strip (or polybagged). If desired, the address for the magazine may be printed on the advertising brochure, and that printed address may be used to mail the magazine and brochure.

DETAILED DESCRIPTION OF THE DRAWINGS

Figure 1A:
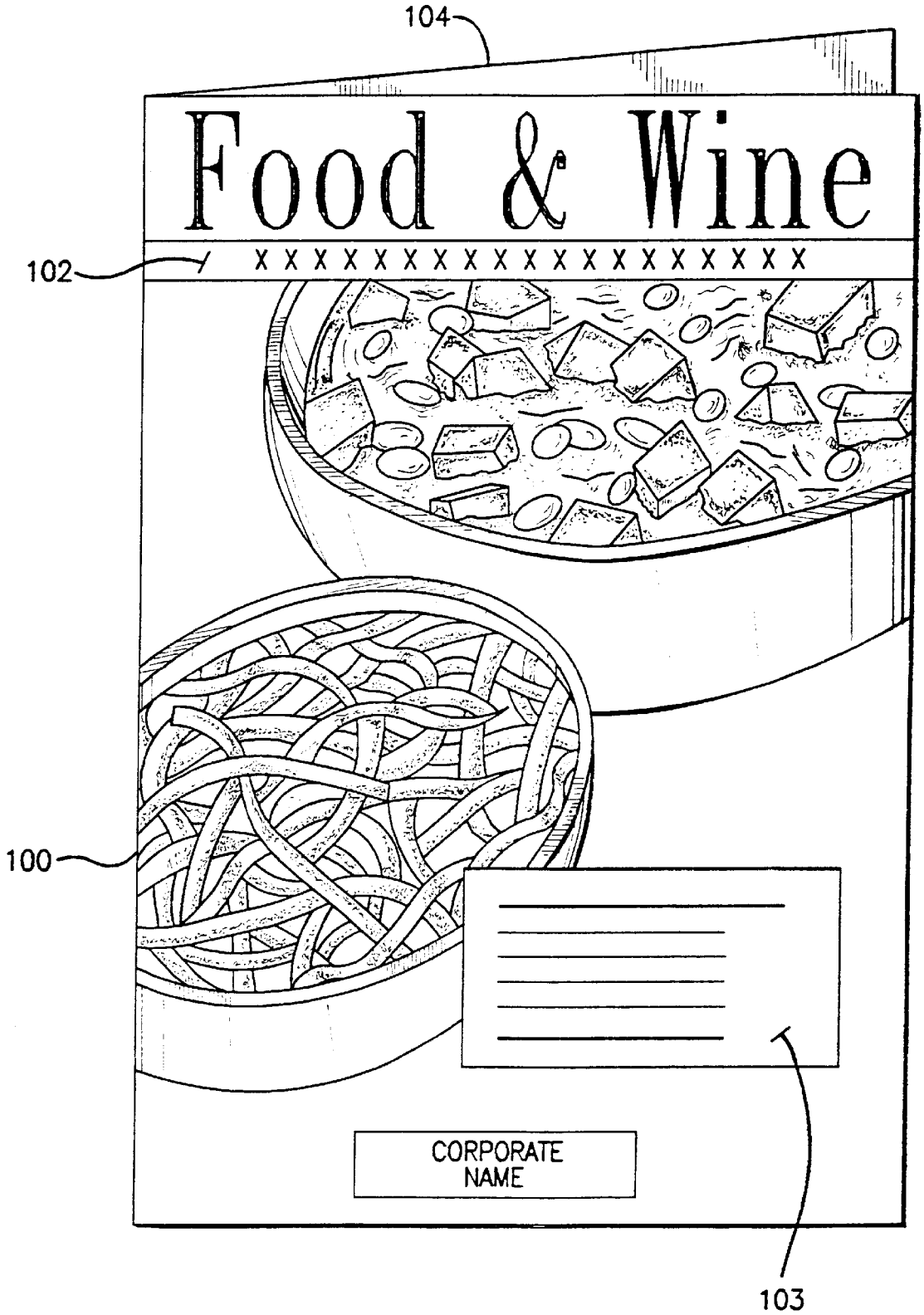
FIG. 1A–1D show plan views of a front cover page and first and second interior pages, respectively, of exemplary promotional brochures, in accordance with the present invention.
Figure 1B:
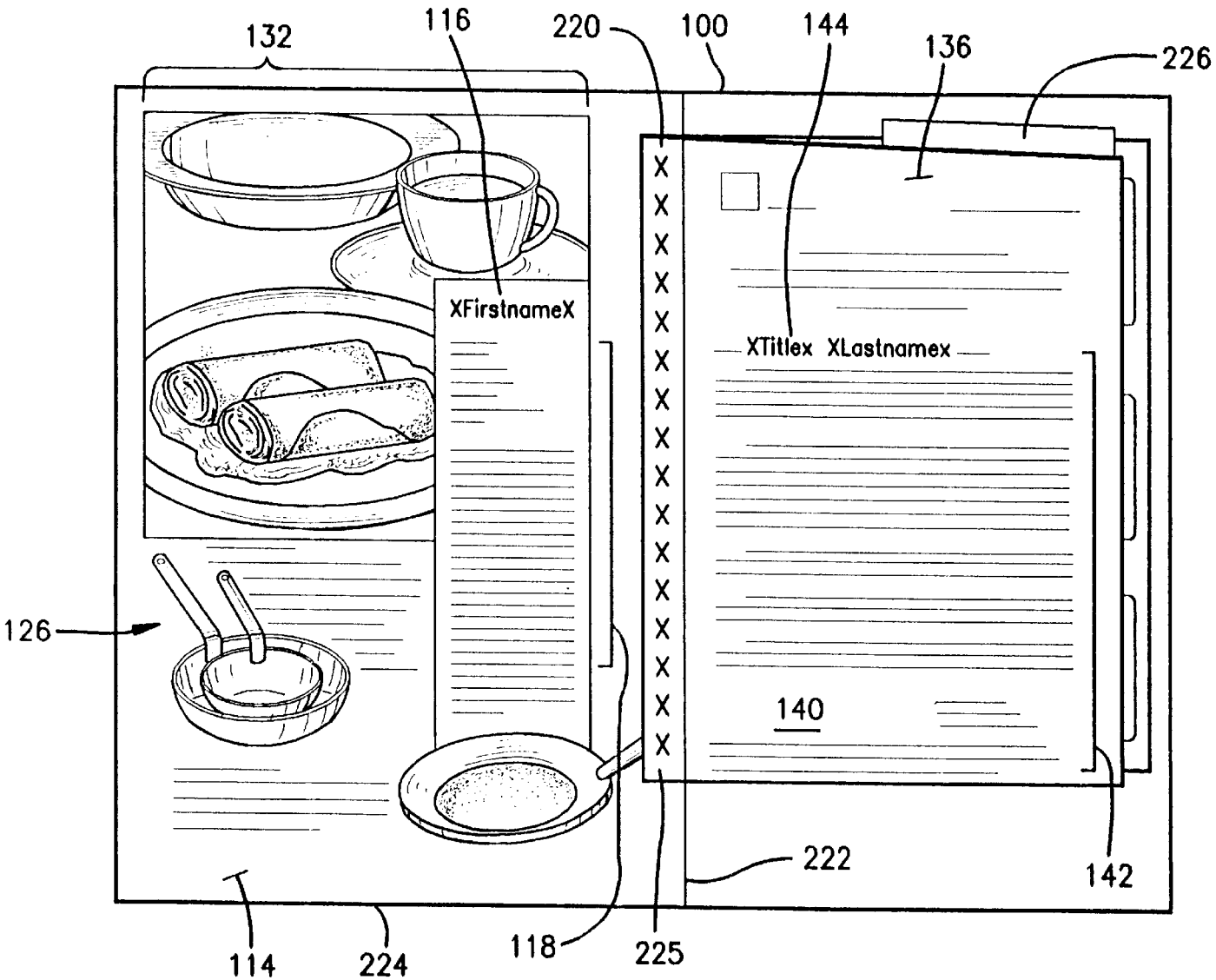
Figure 4:
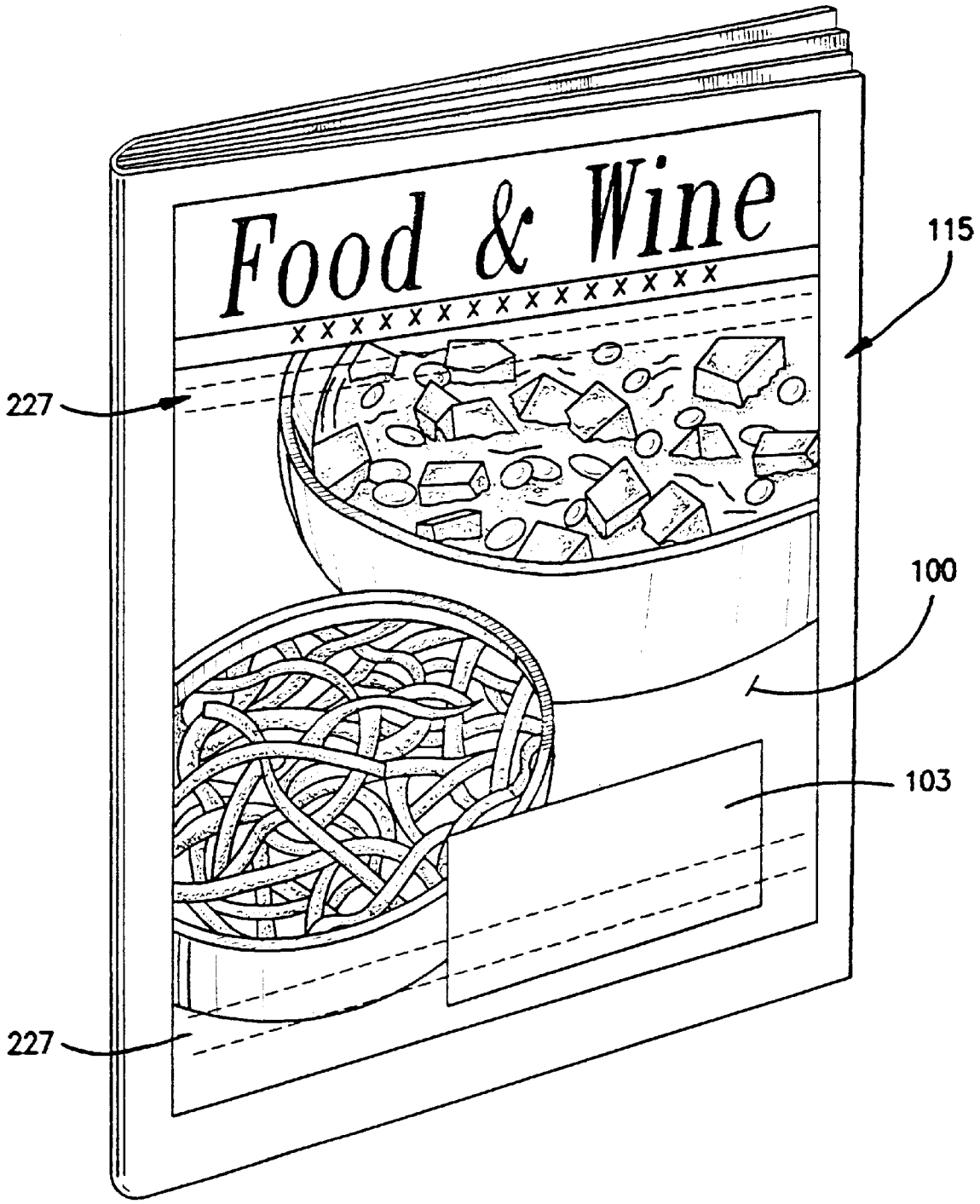
FIG. 4 shows the brochure shown in FIGURES IA to ID, attached to a magazine for mailing.

FIGS. 1A and 1B show an exemplary advertising and promotional brochure 100 to be attached for mailing to a magazine, as is shown in FIG. 4. The front cover page 102 of the brochure may, for example, have the appearance of the cover page of a magazine and include a variable print field 103 for the subscriber's name and address. The back cover page of the brochure 104, shown in FIG. 1C, may include a subscriber address section 106, an area for postage 108, a return address section 110, and an advertisement area 112 for promotional and other information. The advertisement area may include variable print information, such as the subscriber's name 113.

The brochure is intended to be attached to a magazine 115 and referred to as "attached mail", as shown in FIG. 4. Attached mail is a supplement to a magazine that is mailed with the magazine. Under U.S. postal regulations, attached mail does not require additional postage and can be mailed with the magazine without incurring additional postage costs. The postage free feature of the brochure 100 provides a substantial cost advantage to the brochure over other times of mailed advertisements. An advantage of the present invention is that the brochure provides an effective marketing and promotional device, that can be mailed postage free along with a magazine already being delivered to the intended recipient of the brochure.

A computer selection process can be run to select those persons who subscribe to a magazine to receive the brochure 100. An advertiser or promoter may target the brochure to an audience of magazine subscribers. Alternatively, a business may direct a brochure to its own customers, who also subscribe to a particular magazine. An exemplary criteria for selecting magazine subscribers to receive a brochure 100 may be that the subscribers have been customers of a particular business or members of an organization, or that the magazine subscribers are of a certain age, gender or live in a certain geographic region. The publisher sponsors the brochure and may coordinate with an advertiser or business that provides promotional, advertising, and informational material for the brochure.

Figure 5A:
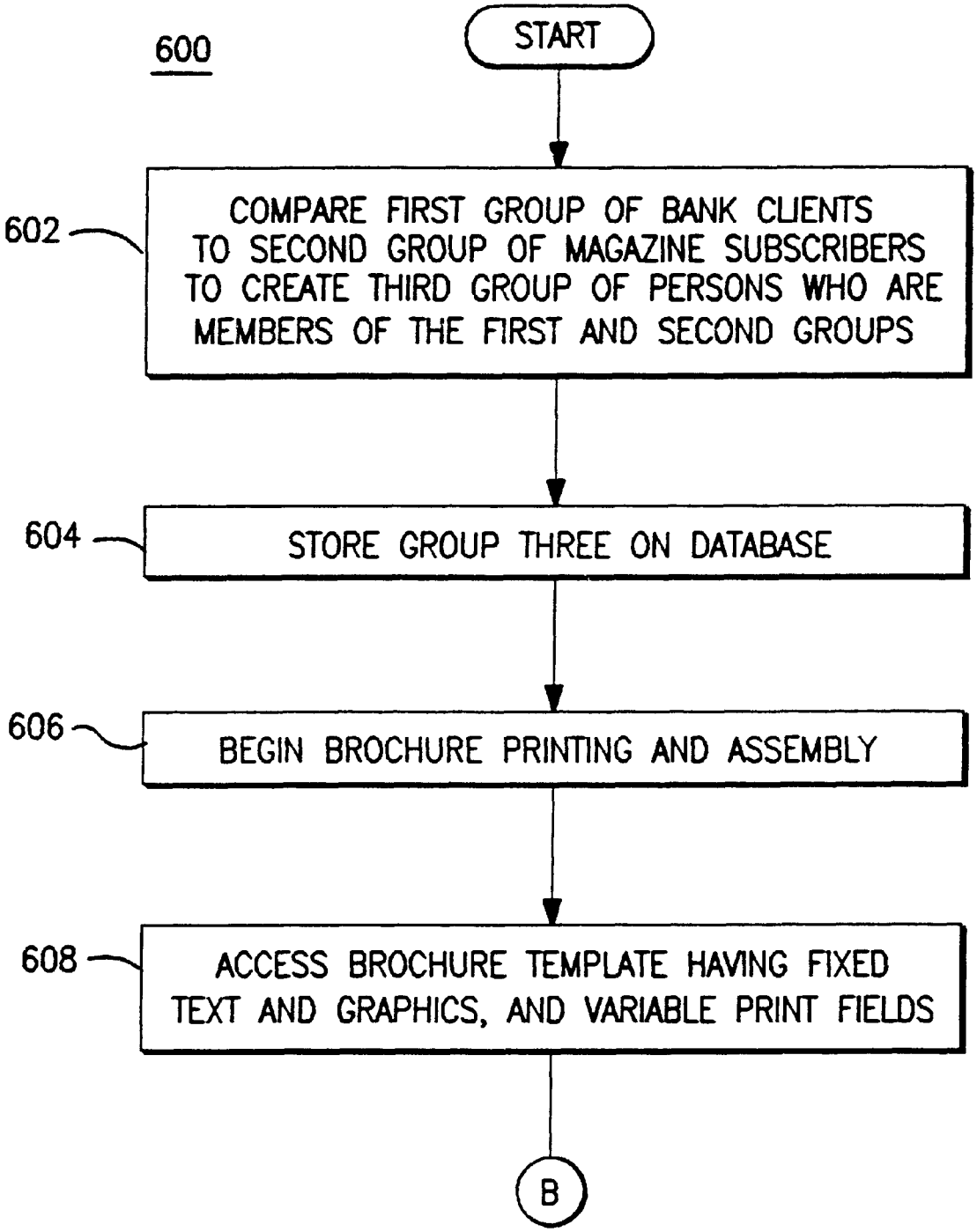
FIGS. 5A and 5B are computer program flow charts showing an exemplary computerized process for printing and assembling the brochures shown in FIGS. 1A to 1D.
Figure 5B:
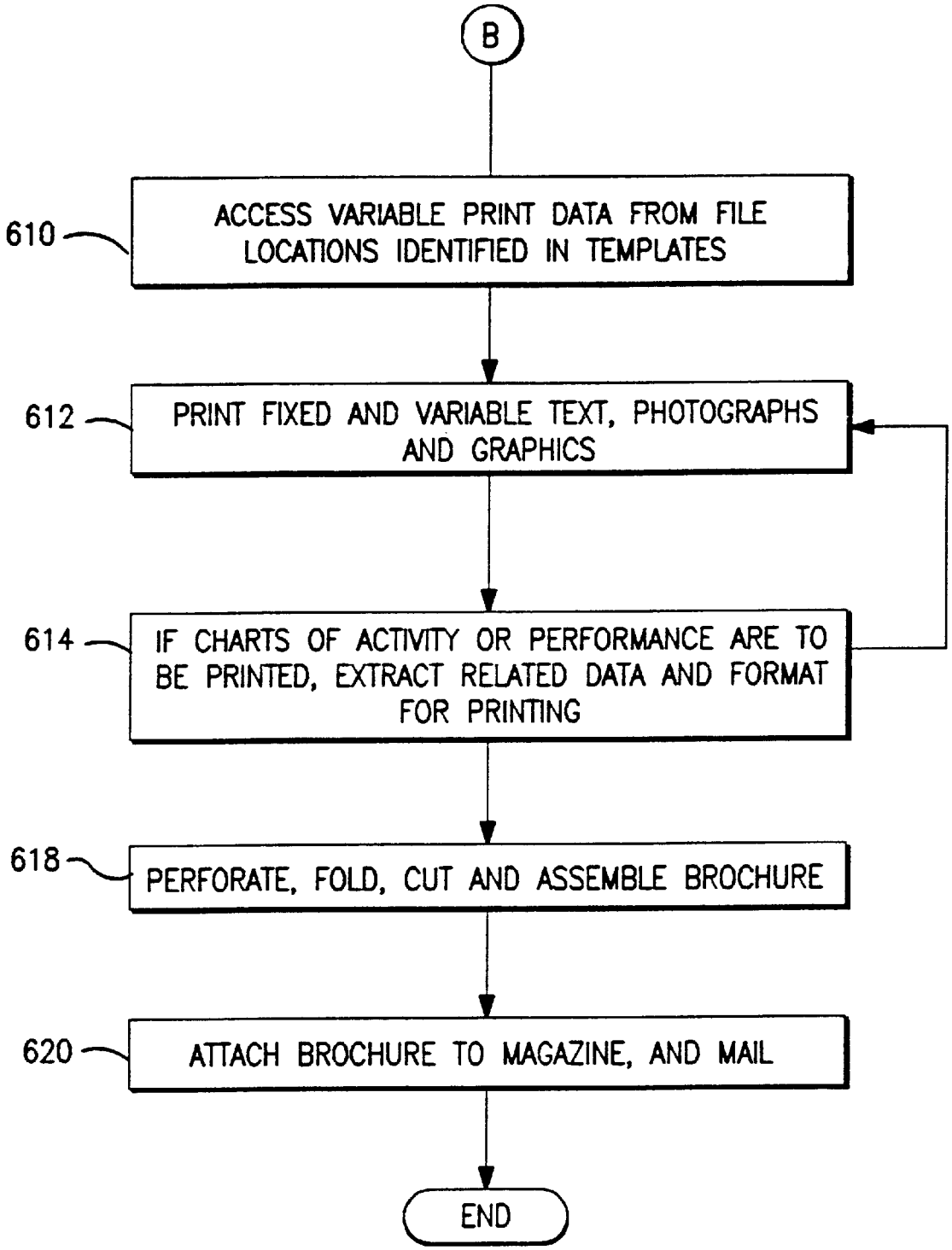

FIG. 5 is an exemplary computer flow chart 600 of a process for printing and assembling a brochure 100. A bank or credit card company, for example, may distribute a brochure regarding pre-approved credit cards by attaching the brochure to a magazine having subscribers that the bank or credit card company wants to target as prospective customers. A list of pre-approved credit card clients may be prepared by the bank or credit card, and compared to a list of subscribers of a magazine, in step 602. These lists of potential credit card clients and magazine subscribers may be maintained in computer databases, step 604. Conventional processes for merging or purging lists in databases are utilized to identify those persons on both lists of pre-approved credit card clients and of subscribers. For example, persons who are both pre-approved and subscribers of the magazine may be selected to receive a brochure 100 with their next subscription magazine. A third computer database list is compiled in step 604 of those persons who are to receive the brochure, in that they are both pre-approved for credit cards and subscribers of a magazine.

Once a list of magazine subscribers to receive the brochure 100 is compiled, the process of printing and assembling the brochure is begun in step 606. A brochure template is selected from computer memory storage, in step 608. The template may include the layout parameters of the brochure, such as page size; number of pages; fixed text, photographs and graphics, and blocked-out areas for variable text, photographs and graphics. A separate template may be used for each web substrate used to manufacture the brochure. Fixed text, photographs and graphics are those that are printed on every brochure and do not vary during a print run.

Variable text, photographs and graphics (collectively variable print data) are those that do vary from one printed brochure to the next, in a single print run. Because variable print data changes, a brochure template blocks out an area of the brochure to receive the variable printing, and may include a computer file name or database field that identifies the location in computer memory from which variable data is obtained during the print process, in step 610.

Figure 1C:
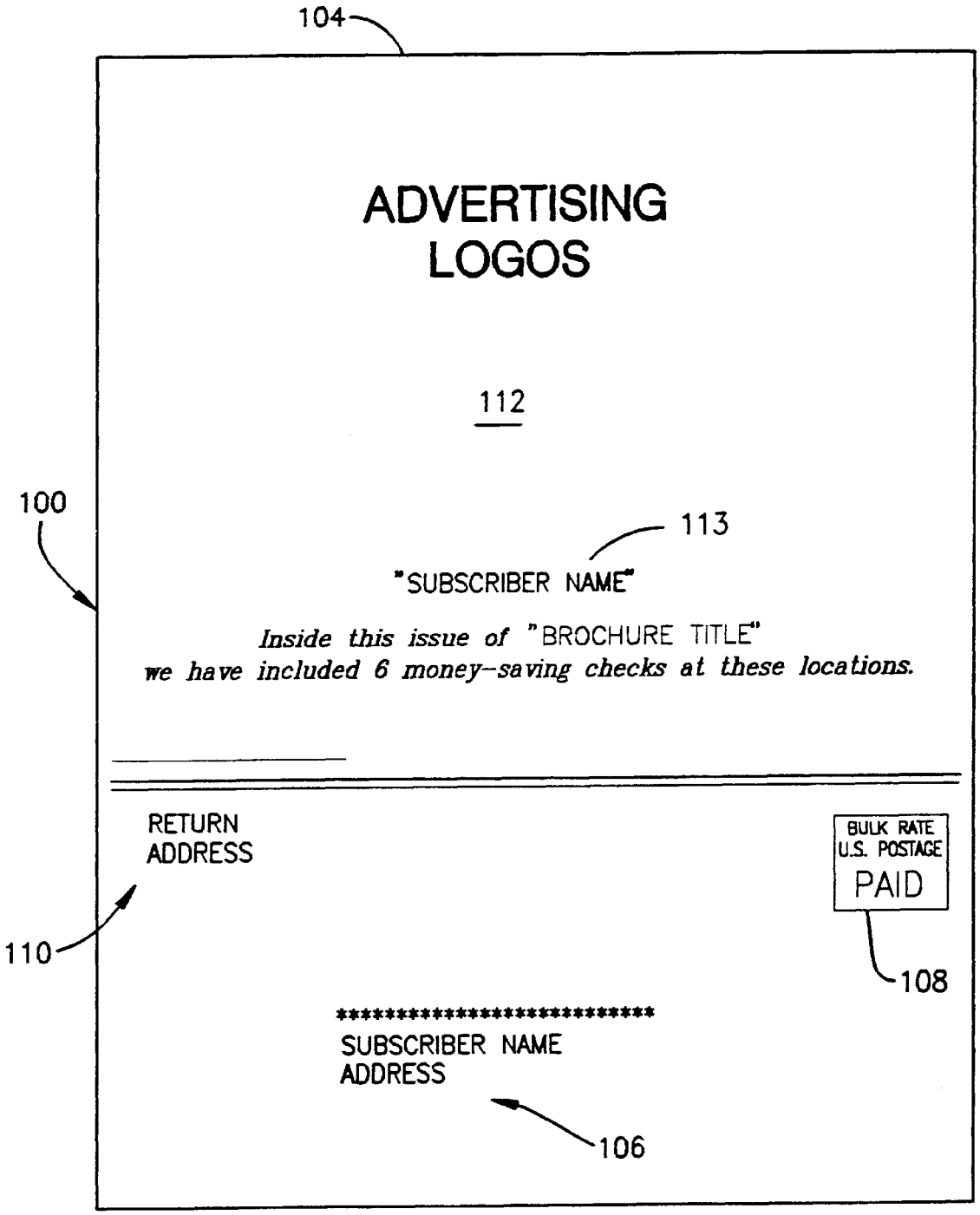

The address of the subscriber (addressee) is an example of variable print data that may be printed on the brochure 100, in step 612. The addressee section 106 back page 104 of the brochure, shown in FIG. 1C, is printed with the address of a subscriber to a magazine. The printed address of the subscriber may be used as the mailing address for the magazine. The addressee section 106 may also include alphanumeric information associated with the magazine, such as the subscription number, or associated with the business publishing the brochure, such as a customer number. Furthermore, the addressee section may include bar codes and other machine readable information to facilitate the distribution, collating and mail handling of the brochure and magazine. By attaching the brochure to the magazine such that the addressee section is exposed and readily viewable by mail sorting equipment and mail delivery persons, the address on the brochure 100 may be used to direct the magazine to the proper address. Accordingly, the cost of applying an address directly to a magazine is avoided, if the addressee section 106 of the brochure is used as the mailing address for the magazine.

The inside pages of the brochure, shown in FIG. 1B, may include text, graphics, pictures, return mailers, coupons, other inserts, and other materials and information associated with the message to be conveyed by the brochure. For example, a first inside page 114 may include personalized information related to the addressee. The name of the addressee 116 may be printed at various positions in the brochure, in addition to the addressee section on the back cove. The template may include a database field code, e.g., "xfirstnamex", to identify a database field having the subscribers first name. The first and/or last name 116 of the addressee may be inserted into fixed text 118 on an inside page, e.g., 114, of the brochure. By placing the first and/or last name of the addressee in fixed text, the text becomes personalized to the magazine subscriber. The subscriber is more likely to read the text of the brochure and to be more receptive to the message of the brochure, because his name in interspersed in the text of the brochure.

Figure 1D:
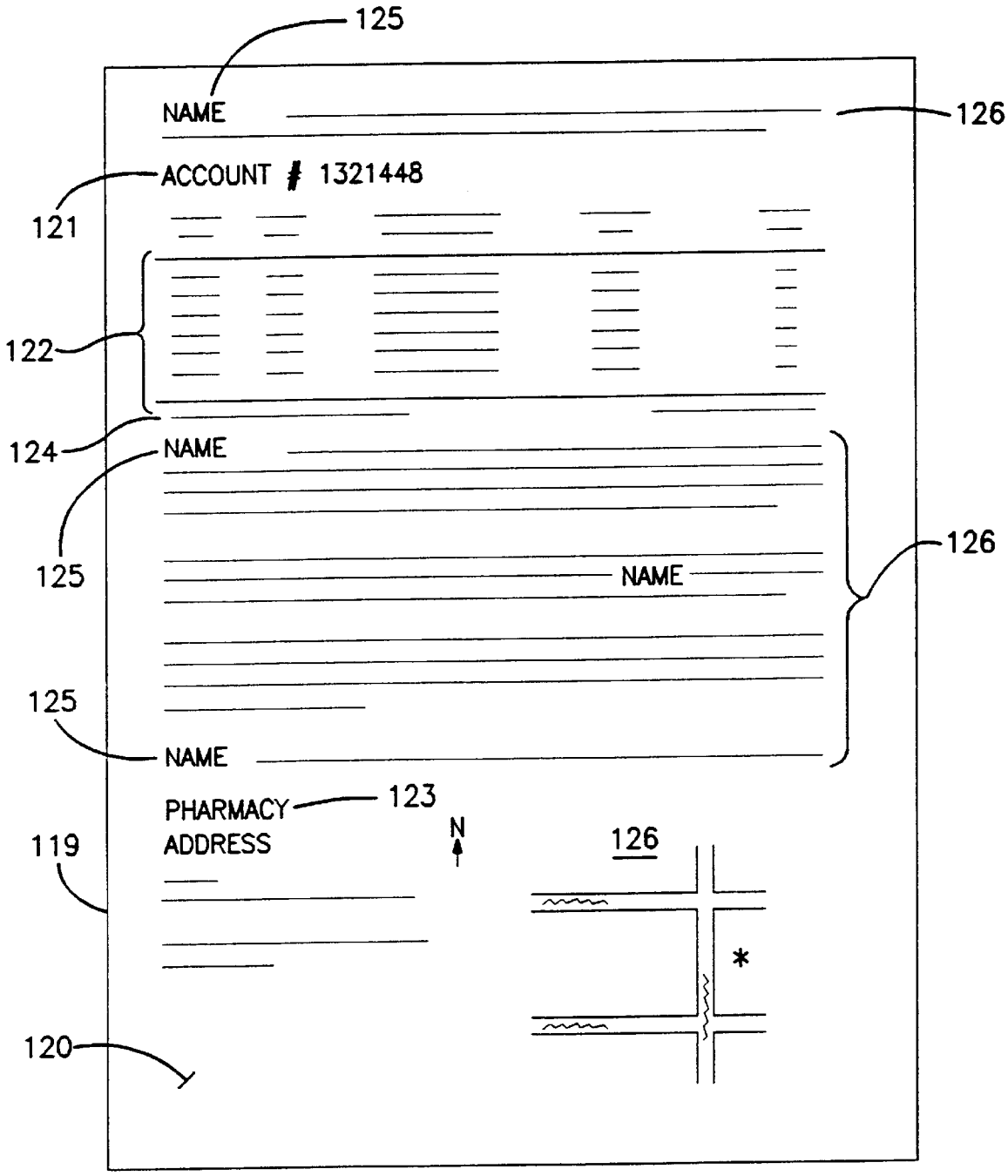

The first inside page 114 of the brochure (or any other brochure page) may also be used to present information specifically associated with the subscriber. FIG. 1D shows the inside pages of another brochure 119 for a health care maintenance company. This brochure 119 is similar in most respects to the brochure 100. The health care brochure 119 also includes on its first inside page 120 the subscriber's account number 121, and a chart 122 reporting certain healthy activity taken by the subscriber. For example, the chart may list the coupons (which may be promotional checks, rebates, bank notes and checks, purchase discounts, etc.) the subscriber used for healthy activities, such as for exercise, exercise equipment, vision and other physical checkups, and for drugs used to stay healthy. The chart 122 lists the healthy activities and provides a total 124 of health care bonus points. The information provided in the list may be obtained from a database that tracks and correlates healthy activity bonus points to individual subscribers of a health plan.

During the printing process of an individual brochure, the database of healthy activity bonus points is accessed to extract that information related to the subscriber to whom the brochure is being addressed in step 614. The data from the database may be formatted into, for example, a table 122 that conveniently displays the data. The formatting of the database can be done by computers during the print process.

In addition, graphical information, such as maps 126, may be printed on an inside page of the brochure, or on the cover if so desired. The map may be a fixed graphic that is printed with each and every brochure, or the graphic may be unique graphic generated by a computer for each addressee of the brochure. For example, the map 126 may be selected to correspond to the nearest health care facility 123 near the addresses. Accordingly, the map may be selected from a database of maps (or generated from using conventional software that generates street maps) that correspond to the subscribers, whose name 125 is printed liberally in the fixed text 126 of the page.

The inside pages may also include fixed text and graphics, or variable text and/or graphics selected for each addressee during the print process. The fixed text 126 and fixed graphics 132 may be public service and/or editorial information, such as one would typically find in a magazine. It is preferable for twenty-five (25%) percent or more of the brochure to be public service and/or editorial information. U.S. Postal regulations require that magazine attachments include 25% or more public service and/or editorial information to qualify for the free postage, when attached to a magazine or other periodical. A brochure that has less than 25% of editorial and public service information would require additional postage to be mailed with the magazine. To comply with the 25% minimum requirement, the editorial or public service copy can be interspersed throughout the brochure. For example, one of the four pages of the brochure may be devoted to public service and editorial information to qualify for free postage, when the brochure 100, 119 is attached to and mailed with a magazine or periodical.

As shown in FIG. 1B, inserts 136 may be included in the brochure. These inserts may include fixed and/or variable text and/or graphics, such as shown on the single sheet insert 136. The front page 140 of the first insert sheet includes fixed text 142 and variable text 144, such as the name of the subscriber. The front page 140 of the insert may explain the coupons on the other insert sheets underneath the first sheet.

Figure 2:
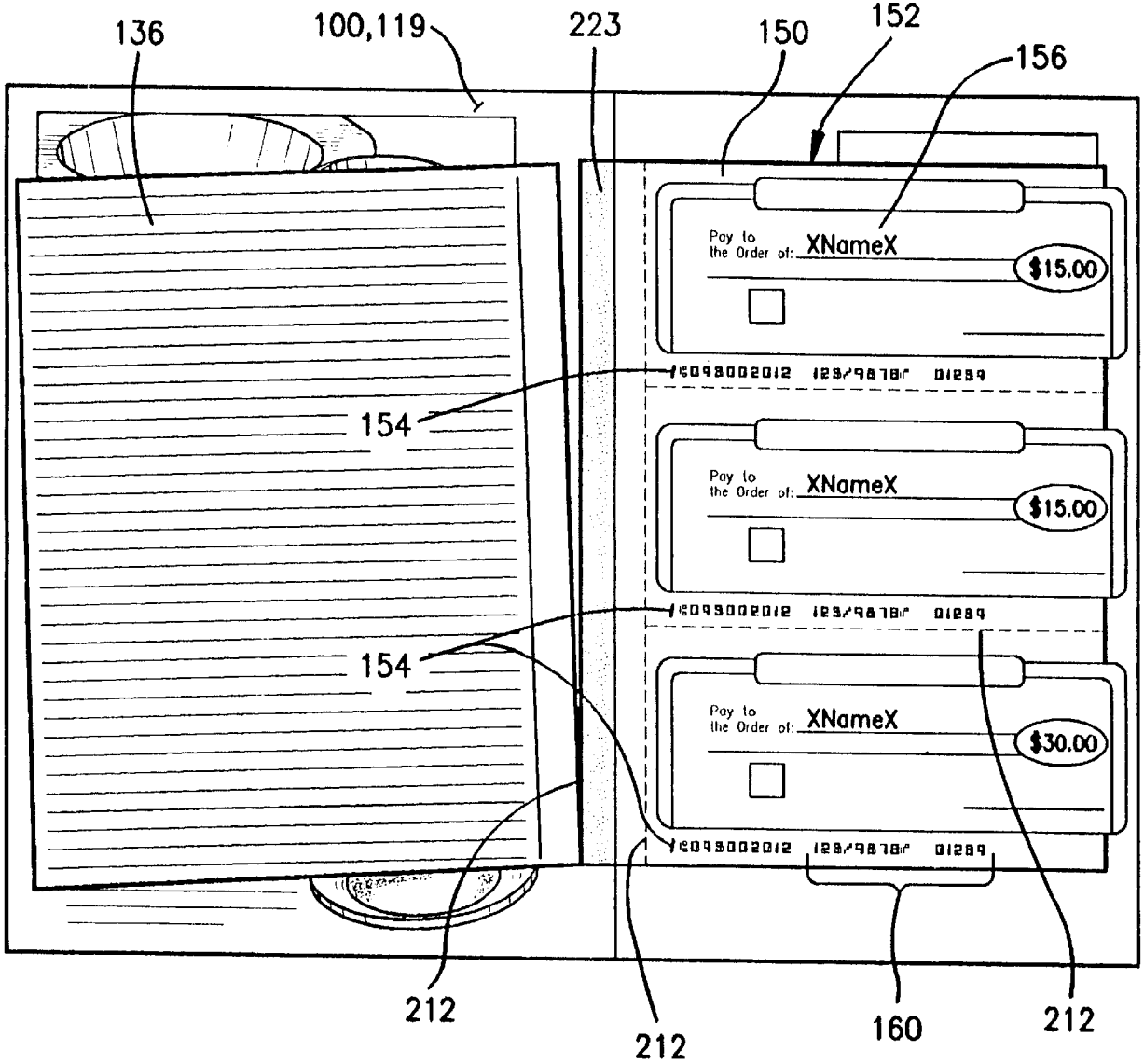
FIG. 2 shows a plan view of a front side and a back side of an insert to the brochures shown in FIG. 1A to 1D.

The second and third sheet inserts 150, 152, respectively, are similar and are shown in FIG. 2. In the example shown here, the second and third sheet inserts are detachable coupons 154. The coupons may be for discount purchases, rebates, two-for-one sales and any other promotion that is desired by the business. In addition to coupons or as an alternative to coupons, the inserts may be return postcard to be filled in with information by the addressee, or may contain further text and/or graphics. The coupons 154 shown here may be used to obtain discounts on products and services that are healthy for the addressee. The coupons may be printed with variable information such as the name 156 of the addressee of the brochure.

By using the coupons to purchase products and services, the addressee (magazine subscriber) saves money and obtains additional healthy bonus activity points (for example), which points will be reported in a subsequent brochure addressed to the subscriber. The business can track the effectiveness of its brochure and promote certain desired activities by the subscriber, such as purchasing certain products and services or purchasing healthy products and services, through the use of coupons and tracking the usage of such coupons. As the subscriber uses the coupons to purchase products and service the businesses selling these services and products take the coupons from the customer (addressee of the brochure) and submits them for reimbursement to the business that published the brochure 100, 119.

Upon return of the coupons, the business that published the brochure enters into its computer database data identifying the coupon, the product or service that was purchased with the coupon, and the name of the customer (subscriber) who used the coupon. To assist in collecting data regarding the use of the coupon, the coupon may be printed with computer-readable alphanumeric information 160, such as the type of codes used to track bank checks. Once the data regarding the returned coupons are entered in a database, it can be used to report the addressee's purchasing activities on a subsequent brochures 100, 119 to be sent to the addressee.

The brochure may be formed from a plurality of webs, using web printing, processing and form assembly machinery such as shown in FIGS. 3A to 3D. The first web 162 may be a paper roll 164 having an adhesive coating 166 on a back side 168 of the web. The first web is used to form the front and back covers 102, 104 of the brochure 100, 119. In the disclosed embodiment, the width of the web is more than twice the width of the brochure so that the web can be folded to form side-by-side pages of the brochure. Other orientations of the brochure on the web may also be used. The centerline of the web corresponds to the centerline of the brochure 100.

The web is initially in a roll 164 from which it is unrolled as a single-ply web from a roller unit. The roller unit 170 may have holders for two web rolls, so that one roll may be unrolled and a second web 172 be ready in standby for use when the first web has been fully unrolled. The webs move through a series of rollers 174 and web guides 175 that align the web with respect to the web path, and apply a predetermined level of tension to the moving web. The machinery for moving the web is conventional and well-known.

The web is run through a series of print engines 176 that imprint the text and graphics for the cover and interior pages of the brochure. A laser toner printer station 176 may be used to apply variable print data. The variable print station is controlled by computers that cause the printers to imprint variable information, such as the name and address of the addressee, and the chart listing the addressee's healthy bonus points. After the variable print engine is a laser toner printer 178, the web with toner particles applied moves through an infrared tunnel 180 to cause the toner to permanently adhere to the web. Additional print stations, e.g., color ink jet printers, 182 may next apply fixed text and graphics. For color printing, there may be a separate print engine for each of the three colors used to form color images. Of course, the variable printer may be a series of color ink jet printers, and the fixed text and graphics may be printed with a laser toner printer. In addition, print engines can be mounted on opposite sides of the web if printing is desired on both sides of the web.

The printed web passes through a registration unit 184 that registers the images printed on the web with respect to the position of the moving web. Registration is helpful to ensure that the cuts, perforations, folds, etc. subsequently applied to the web are properly aligned with the images and text printed on the web. The registered web with cover and interior pages printed, is ready to be assembled into a brochure. The web is transferred to an assembly unit, where the cover pages are combined with the inserts to complete the brochure.

Figure 3A:
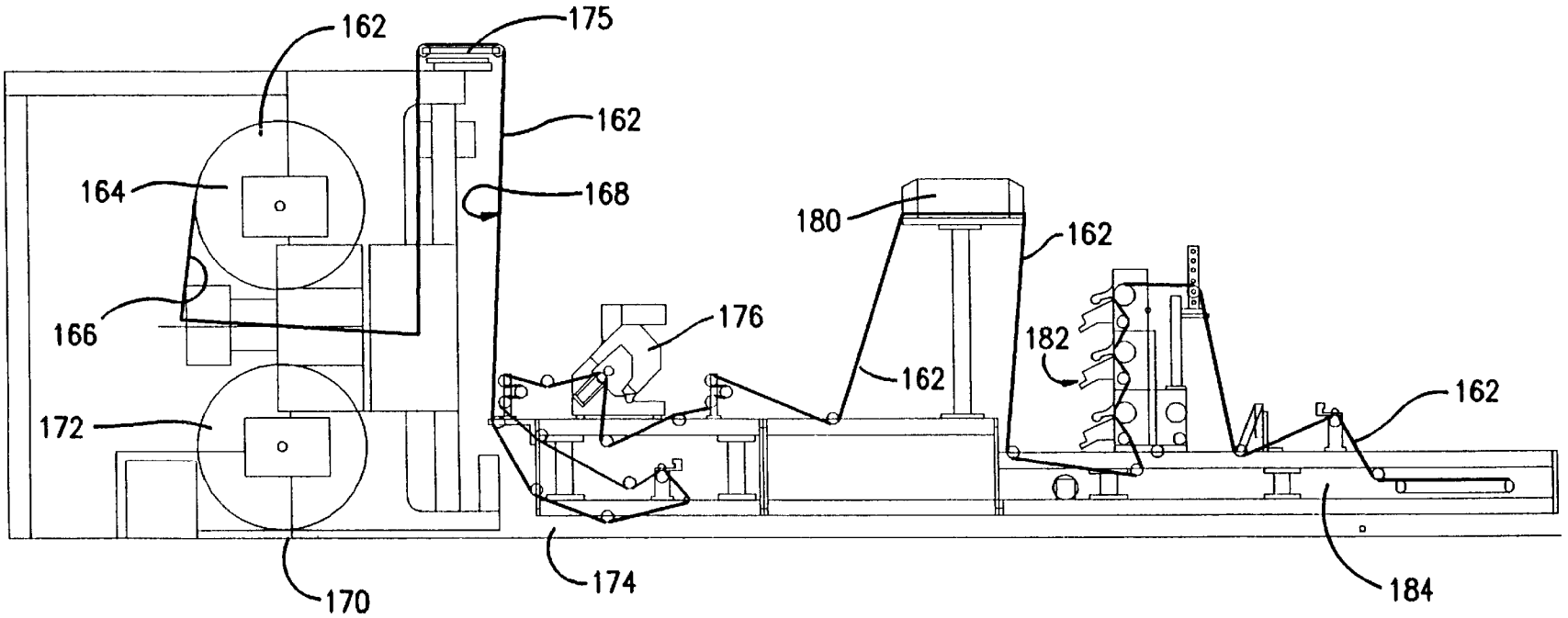
FIGS. 3A, 3B, 3C, and 3D are schematic diagrams showing manufacturing machinery suitable for producing the brochure shown in FIG. 1A to 1D.
Figure 3B:
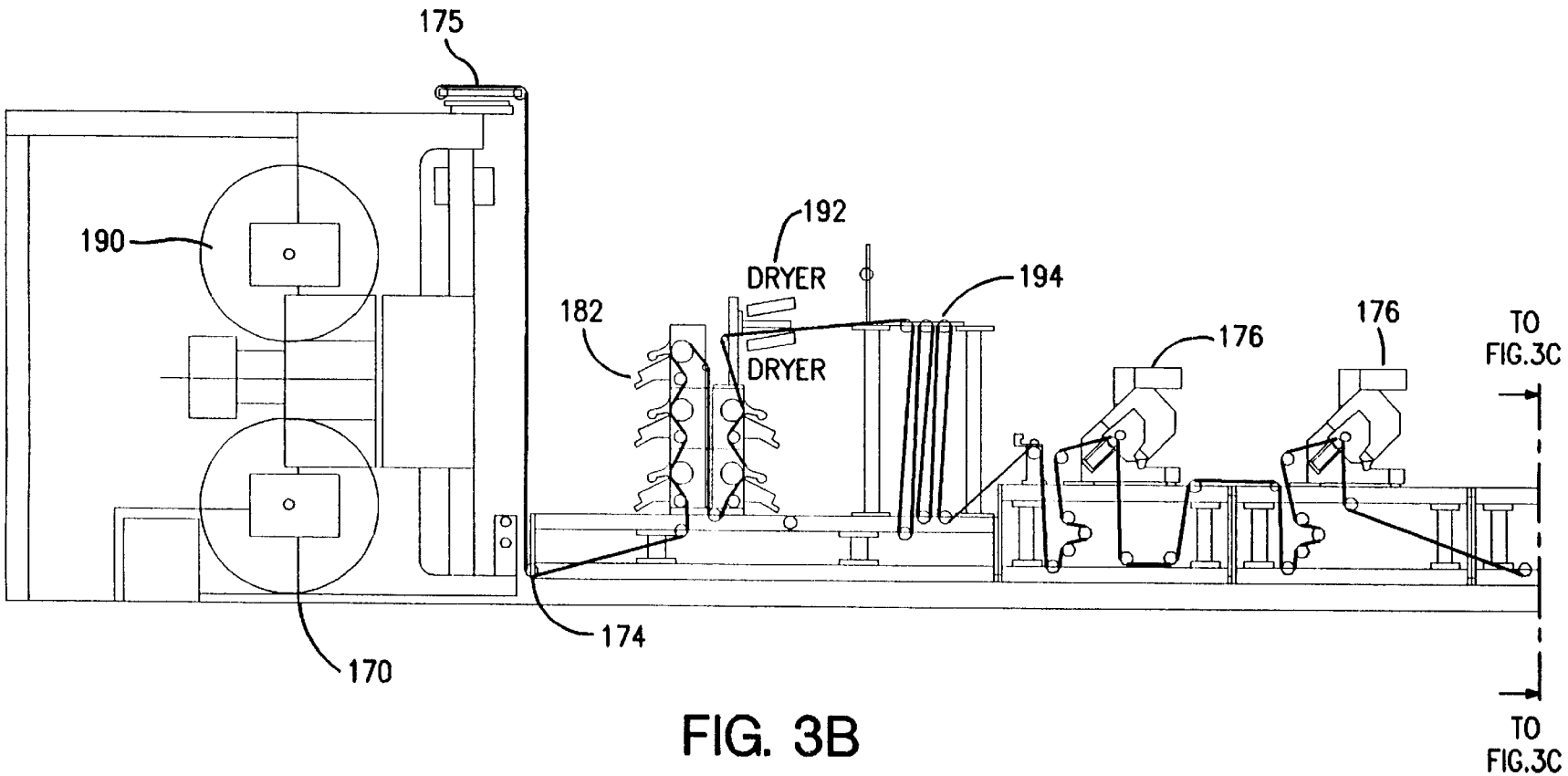
Figure 3C:
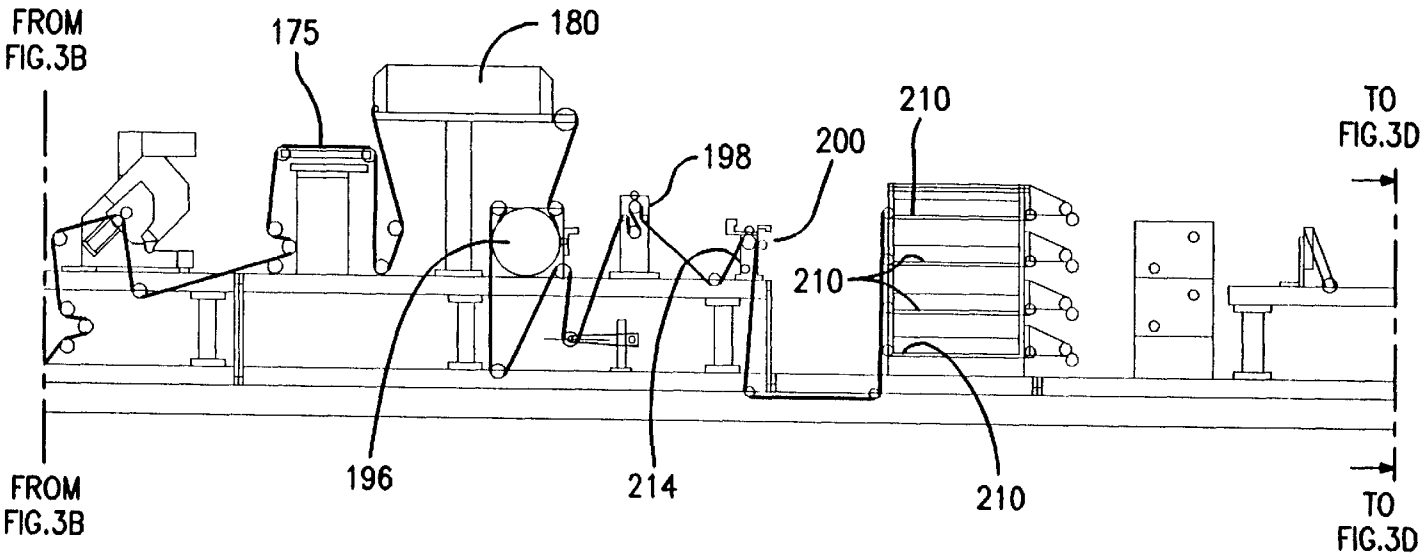
Figure 3D:
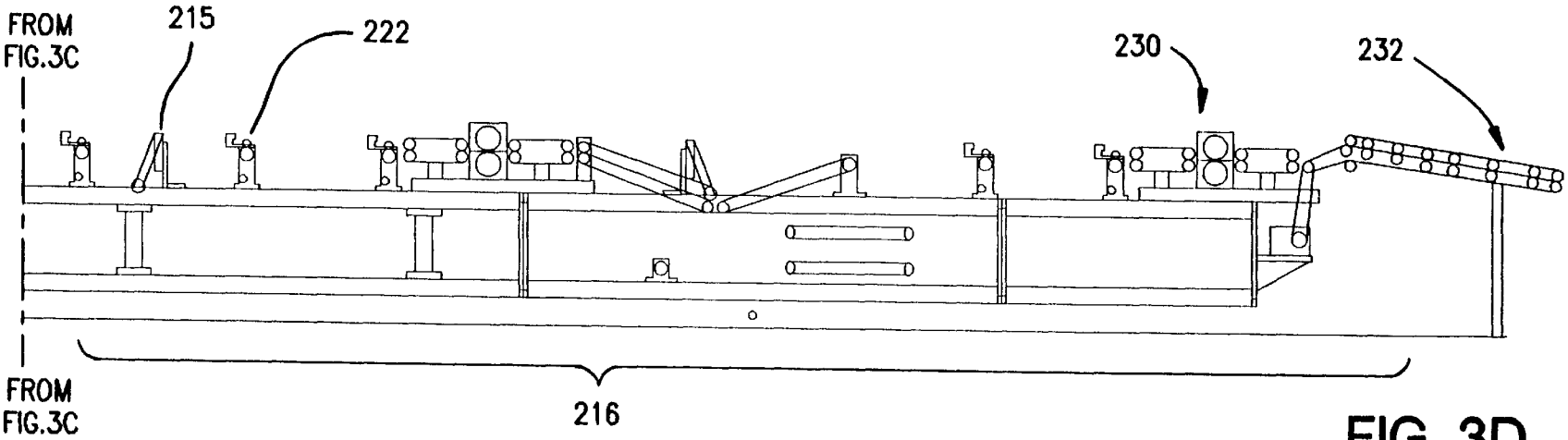

As shown in FIGS. 3B to 3D, the web 190 used to form the inserts to the brochure also starts as a roll unwound from a roller 170. The insert web is aligned with web guides 175 and proceeds to a stack of color ink jet printers 182. The ink jet printer stack 182 prints fixed text and graphics. To dry the liquid ink applied by the ink jet printers, a dryer 192 is applied to the web and a zig-zag dryer unit 194 is used to allow the ink to dry before the web passes to the next print station. A laser toner, variable print station 176 is used to apply color toner particles (three color hues, and black for text). The print engines are shown as printing on one side of the web only. However, the print engines may be arranged to print on the back side of the web as well or the web may be inverted to allow for printing on the back side of the web.

In FIG. 3C, after the laser print engines, the web passes through an infrared (IR) tunnel 180 to melt the toner particles and bind them to the web. The web with hot melted toner particles, may pass over a water cooled drum 196 to cool the web after it exits the IR tunnel. In addition, a servo-driven register unit 198 adjusts the position of the web to align the images printed on the moving web with the position of the web, so that the cuts, folds and perforations to be made on the web are aligned with the images.

Once printing has been completed on the web, the edges of the web are trimmed off with cutter wheels 200, and the web is slit into two or more longitudinal strips 210 by other cutter wheels. The strips are used to form the individual sheets of the inserts to the brochure. With respect to the example shown in FIG. 2, each sheet 136, 150 and 152 of the insert is formed from a strip 210 of the web 190. The strips may be folded in half to form two-ply coupon 154 or page 136, especially if an adhesive coating is applied to the back side of the web 190.

The individual strips 154 may include lines of weakness, e.g., perforations, 212, which will enable the coupons 154 to be easily separated from the insert page 150, or allow an entire page 136 to be separated from the brochure. These lines of weakness may be formed by perforation wheels 214. In addition, labels may be optionally applied to the webs in a label applicator 215.

The strips 154 are separated into individual insert sheets 136, 150, 152 in the brochure assembly section 216. The individual sheets are collated together and may be bonded together with an adhesive strip 220 applied by an adhesive applicator 222.

The collated insert sheets are assembled with the front and back cover sheet formed from the first web. A conveyor (not shown) moves the cover sheet to the assembly section 216. Using conventional folding and merging units, the cover sheet is folded and receives the insert sheets 136, 150 and 152. An adhesive strip 220 applied adjacent a fold line 223 of the cover sheet 224 may be used to secure the insert pages to the cover sheet of the brochure. A flap 225 of the insert sheets may be used as a binding for attaching the insert sheets to the cover sheet. Alternatively, an adhesive strip may be applied along a top edge 226 of the insert sheets to bond those sheets together and to bond the collection of insert sheets to the cover sheet 224. In addition, one or more adhesive strips 227 may be applied to a back cover page 104 to provide an adhesive bond to the magazine.

Once the brochure is assembled, the brochures may be stacked at station 230 and moved by conveyor 232 to a shipping dock to be transported to a magazine publisher. At the magazine publisher, the brochures may be attached to individual magazines by means of an adhesive strip between the magazine and brochure. The brochure may also (or alternatively) be combined with the magazine by packaging the magazine and brochure in transparent plastic wrapping.

The brochure has printed on an outside face the subscriber's name and mailing address, and postage. Thus, the brochure can be used to address the magazine to the subscriber. There is no need to, address the magazine, because the address is already on the brochure.

The invention has been described in connection with what is presently considered to be the most practical and preferred embodiment. The invention is not to be limited to the disclosed embodiment. It covers the various modifications and equivalent arrangements included within the spirit and scope of the appended claims.

What is claimed is:

1. An assembly adapted for mailing, comprising:

a periodical having, front and rear covers;

a promotional insert comprising a plurality-of plys, said promotional insert being disposed adjacent to, to overlie at least a portion of, one of said front and rear covers of said periodical;

a wrapping for enclosing said periodical and said promotional insert; and one of said plys of said promotional insert including a variable data print area for receiving addressee indicia and a print area for postage indicia, said wrapping being transparent at least in part so as to expose said postal indicia and said address indicia through the wrapping, wherein said promotional insert is free from direct mechanical attachment to said periodical so as to be substantially free-floating within said wrapping.

2. An assembly as in claim 1, wherein said promotional insert includes at least one ply bearing at least one of a check and a discount coupon.

3. An assembly as in claim 2, wherein said at least one ply bearing at least one of a check and a discount coupon is detachably secured to remaining plys of said promotional insert.

4. An assembly as in claim 1, wherein said promotional insert is adhesively secured to said one of said front and rear covers of said periodical.

5. An assembly as in claim 1, wherein said promotional insert includes a plurality of plys comprising at least one of a coupon and a check.

6. An assembly as in claim 1, wherein the periodical is a magazine.

7. A package as in claim 1, wherein the promotional insert comprises an informational brochure.

8. An assembly adapted for mailing, comprising:

a periodical having front and rear covers;

a wrapping enclosing said periodical;

a promotional insert comprising a plurality of plys, said promotional insert being disposed in said wrapping and adjacent to one of said front and rear covers of said periodical wherein said brochure is free from mechanical attachment to said periodical so as to be substantially free floating within said wrapping; and one of said plys of said promotional insert including a variable data print area for receiving addressee indicia and a print area for postage indicia, said promotional insert being in a side-by-side relation to said periodical so as to expose said postal indicia and said address indicia through said wrapping.

9. An assembly as in claim 8, wherein a wrapping is provided for encapsulating said promotional insert and said periodical, said wrapping being transparent at least in part to expose said postal indicia and address indicia.

10. An assembly as in claim 8, wherein said promotional insert is adhesively secured to said periodical.

11. An assembly as in claim 8, wherein at least one of said plys comprises one of a check and a coupon and is detachably secured to remaining plys of said promotional insert.

* * * * *